United States Patent [19]

Hunt et al.

[11] Patent Number: 5,075,932

[45] Date of Patent: Dec. 31, 1991

[54] CORD HOLDER

[76] Inventors: Richard C. Hunt, 3133 Emigration Canyon Rd., Salt Lake City, Utah 84108; Kenneth P. Kozole, 15046 Hesta St., Poway, Calif. 92064

[21] Appl. No.: 572,815

[22] Filed: Aug. 27, 1990

[51] Int. Cl.[5] ..... B65D 63/00; A44B 11/25

[52] U.S. Cl. ..... 24/16 PB; 24/196

[58] Field of Search ..... 24/16 PB, 306, 442, 24/196, 197, 68 CD, 265 BC, 265 AL, 616, 625; 248/74.3

[56] References Cited

U.S. PATENT DOCUMENTS

| | | | |
|---|---|---|---|
| 1,697,833 | 1/1929 | Lane | 24/197 |
| 3,006,048 | 10/1961 | Windish | 24/16 PB |
| 3,197,830 | 5/1964 | Hoadley . | |
| 3,601,863 | 8/1971 | Dorsey | 24/16 PB |
| 3,672,007 | 6/1972 | Steinberg et al. | 24/196 |
| 4,118,837 | 10/1978 | Hoch | 24/306 |
| 4,150,464 | 4/1979 | Tracy | 24/196 |
| 4,182,005 | 1/1980 | Harrington . | |
| 4,780.935 | 11/1988 | Palombit | 24/16 PB |
| 4,825,515 | 5/1989 | Wolterstorff, Jr. | 24/196 |

FOREIGN PATENT DOCUMENTS

| | | | |
|---|---|---|---|
| 381603 | 10/1964 | | |
| 0102224 | 10/1965 | Denmark | 24/16 PB |

*Primary Examiner*—Victor N. Sakran

*Attorney, Agent, or Firm*—Mallinckrodt & Mallinckrodt

[57] ABSTRACT

A strap device for retaining in coiled condition of a coiled length of slender flexible material, such as an electrical extension cord, and for hanging it for storage, comprises a length of flexible strap material attached to a buckle formed to receive opposite end portions of the strap such that a relatively large loop can be provided by one of the end portions of the strap to encircle the coiled length and a relatively small loop can be provided at a doubled back-on-itself part of the other of the end portions of the strap to receive and retain an end portion of the coiled length, a cinch slide member being variously provided for closing the loop tightly about such received end portion of the coiled length, and a suspension-hook-receiving member being provided in preferably the end portion of the strap that provides the relatively small loop.

8 Claims, 2 Drawing Sheets

CORD HOLDER

BACKGROUND OF THE INVENTION

1. Field

The invention is in the field of devices for retaining in coiled condition lengths of slender, flexible material, such as electrical extension cords.

2. State of the Art

Devices for the purpose have been developed heretofore. For example, Harrington U.S. Pat. No. 4,182,005 provides a body formed of a polymer plastic material with a strap integral therewith and capable of being passed through slots in the body so as to form relatively large and relatively small loops of the strap at opposite sides of the body for receiving and retaining a coiled electrical extension cord and one of the plug ends thereof, respectively.

SUMMARY OF THE INVENTION

In accordance with the present invention and as a part thereof, it has been recognized that a simpler device for the purpose might be provided from readily available components if they properly combined to form an easily fabricated and economical commercial article capable of being hung and stored on a receiving hook.

Accordingly, the primary objective in the making of the invention was to select from available components those suitable for the purpose and to combine them in such a manner as to most effectively accomplish such purpose.

THE DRAWINGS

Embodiments of the invention representing the best modes presently contemplated of carrying it out in actual practice are illustrated in the accompanying drawings which:

FIG. 1 is a pictorial view showing the device of the invention in its most preferred form as it is being applied to a coiled electrical cord, which is shown fragmentarily; and FIG. 2, a similar view of a less preferred embodiment of the device of the invention.

DETAILED DESCRIPTION OF THE ILLUSTRATED EMBODIMENTS

Figure 1:
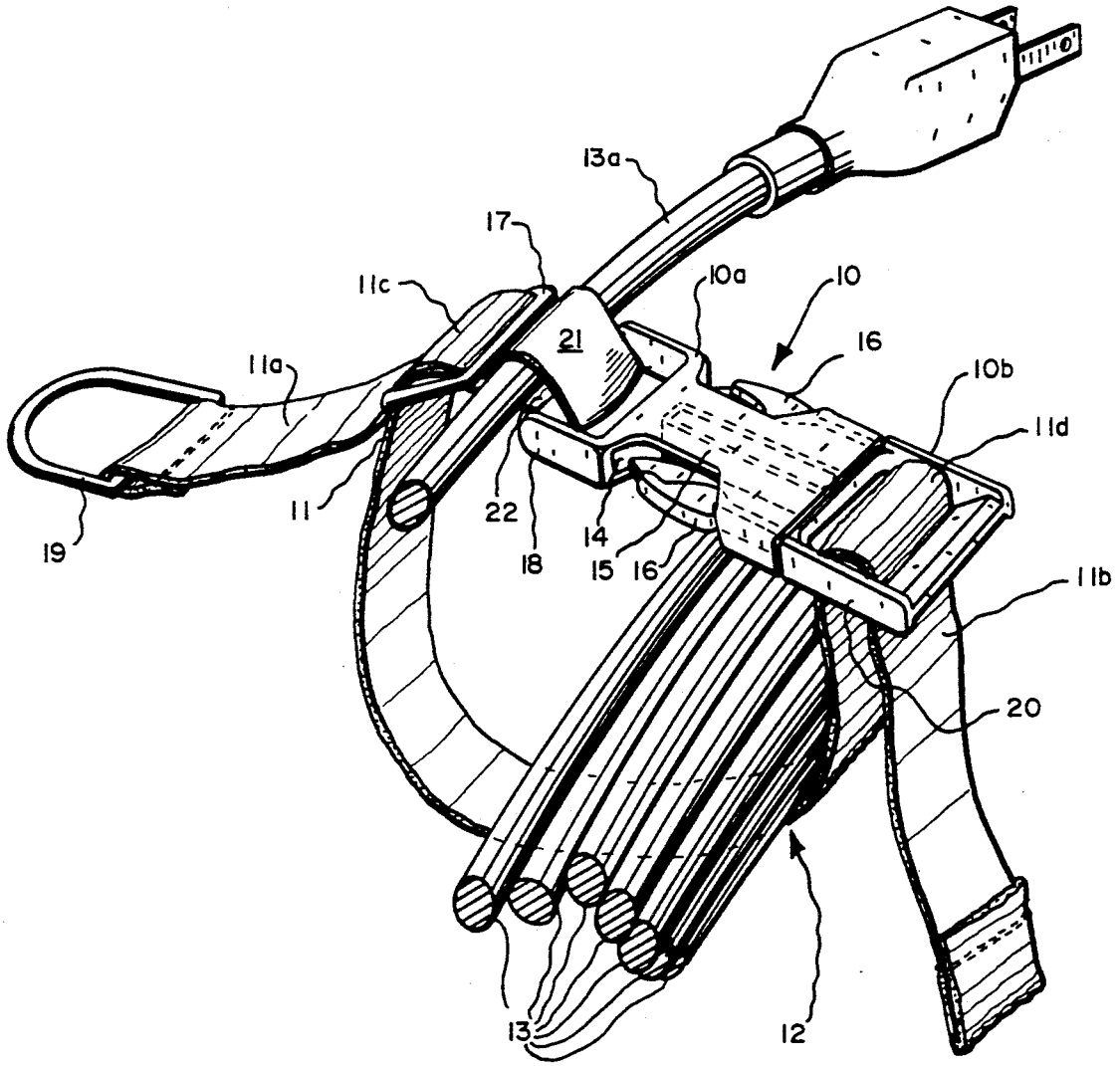

As illustrated in FIG. 1, it is preferred to employ a manually operated buckle 10 of a two-part separable type obtainable on the open market under the designation BSR-1A as produced by ACK of New York, N.Y. 10018.

A length of a highly flexible strap material, such as a textile fabric woven for example from a synthetic fiber, provides a strap 11 which engages opposite ends of buckle 10 in a manner providing a relatively large loop 12 for encompassing a coil of electrical extension cord 13, either wholly, as bunched together in an elongate, closed coil, or partially, at one side of the coil, if the coil is circular and open at the center.

Buckle 10 has one part 10*a*, which is recessed, as at 14, to receive an elongate plug-in member 15 and flanking resilient catch members 16 of the second buckle part 10*b* in the buckling of loop 12 of strap 11 about the received portion of the coiled electrical cord 13.

In this embodiment of the device of the invention, one end portion 11*a* of strap 11 is passed through a conventional strap-bight-forming and cinching slide fitting 17, then through a slotted receiving end 18 of buckle part 10*a* , and then is turned back on itself to again pass through slide fitting 17 and to extend freely thereform. To the free terminal end of such strap end portion 11*a* is secured suspension-hanger-receiving means, here shown as a D-shaped ring 19, adapted to receive and to hang the device and its attached electrical cord from a hook (not shown) for storage. Such ring 19 could, of course, be replaced by a grommet (not shown), if desired, installed in customary fashion directly into the fabric of the strap.

To form loop 12, the opposite end portion 11*b* of strap 11 is passed through the slotted receiving end of buckle part 10*b*, which here is in the form of a strap-bight-forming and cinching fitting 20, so that the received end portion 11*b* of strap 11 is turned back on itself, as shown, and extends freely thereform, providing length whereby loop 12 can be made as large as necessary to encompass the coiled cord as desired.

The portion 21 of strap end portion 11*a* can be pulled through cinch slide 17 to obtain greater length and to form a relatively small loop 22 into which one of the plug-end portions, see 13*a*, of electrical cord 13 can be inserted, after which cinch slide 17 can be slid along the strap to cinch such loop 22 tightly against the inserted cord end portion 13*a*.

If desired, either strap portion 11*c* or 11*d* may be selected and pulled to form a relatively small, cord-end-receiving loop from the adjacent free end of strap 11 for insertion thereinto of a plug-end portion of the electrical cord, the corresponding free end of the strap then being pulled to bring the loop tighter against such received end portion of the cord.

Figure 2:
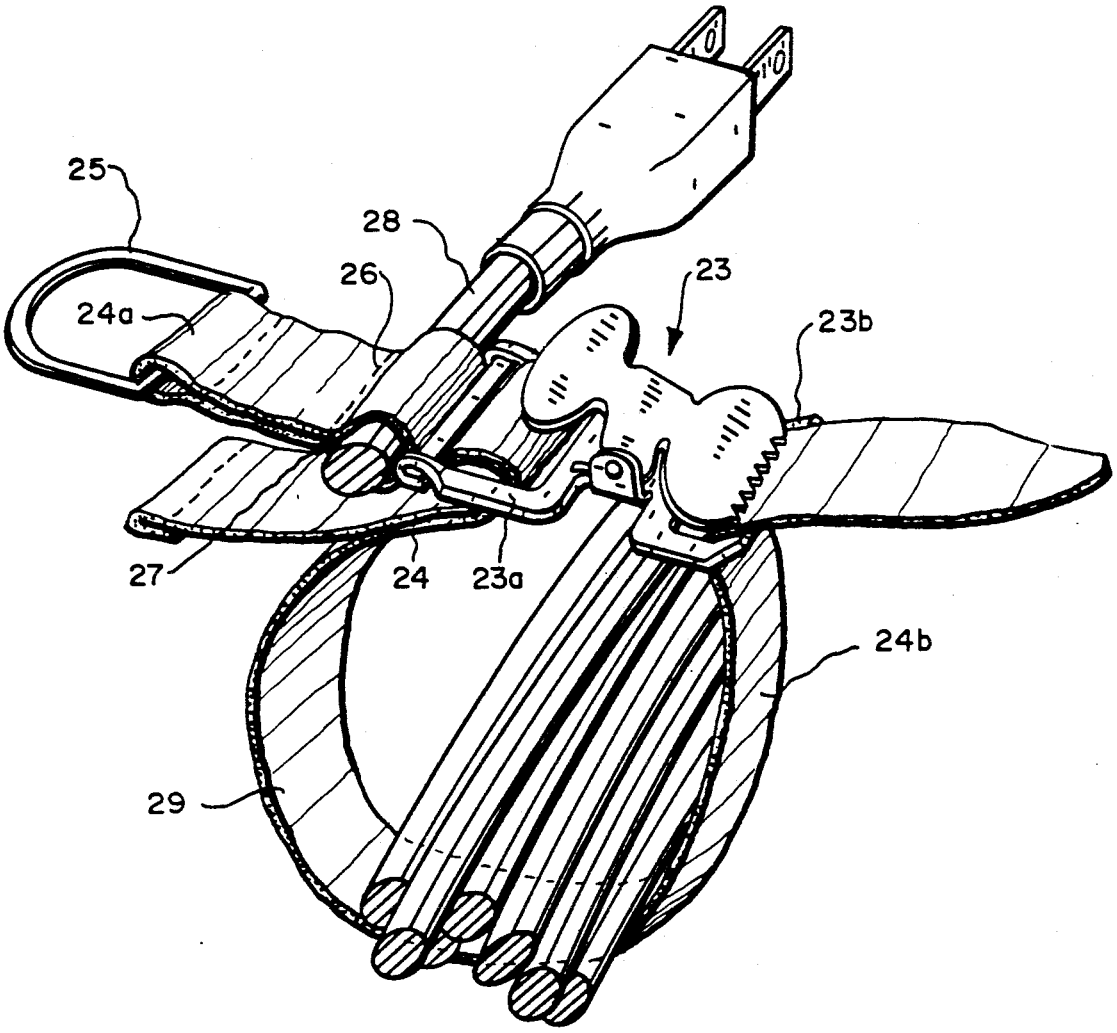

Other types of buckles and other arrangements of the strap can be used within the purview of the invention. Thus, as shown in FIG. 2, a commercially available buckle 23 of essentially unitary construction could less desirably be employed with the strap 24, such strap having one end portion 24*a* passed through a strap-bight-forming and cinching end portion 23*a* of the buckle and on to double back on itself through a D-shaped suspension ring 25 and again through cinching end portion 23*a* of the buckle to hang freely after emerging therefrom, the strap double thickness being stitched together transversely across the width of the strap, as at 26, so that buckle 23 can be used as a cinch to tighten a relatively small loop 27, formed between such stiching 26 and the cinching end portion 23*a* of the buckle, about the received plug-in end portion 28 of an electric cord.

The other end portion 24*b* of strap 24 is formed into a relatively large loop 29 for encompassing a coiled electric cord, as explained in reference to FIG. 1, by passing its free end through the clamping end portion 23*b* of buckle 23.

As in the first embodiment of FIG. 1, the suspension ring 25 is used to hang the coiled electrical cord from a hook or other support. In either embodiment, a ring or grommet can be fastened to either end portion of the strap, if desired.

Whereas this invention is here illustrated and described with specific reference to embodiments thereof presently contemplated as the best mode of carrying out such invention in actual practice, it is to be understood that various changes may be made in adapting the invention to different embodiments without departing from the broader inventive concepts disclosed herein and comprehended by the claims that follow.

We claim:

1. A strap device for retaining in coiled condition a coiled length of slender and flexible material, such as an electrical extension cord, and for separately receiving and retaining an end portion of such length, comprising a length of flexible strap; a manually operable buckle having two separate but interconnectable parts, one part of which is formed to receive and slidably hold one end portion of said strap turned back upon itself and the other part of which is formed to receive and hold the other end portion of said strap, the said strap having its end portions received and held by said separate parts of the buckle, respectively, whereby when the said two parts of the buckle are separated, a relatively large loop can be formed about bundled length portions of the coiled length of slender and flexible material to encircle and hold said bundled length portions when the said two parts of the buckle are reconnected; and a separate strap-bight-forming and cinching fitting slidably disposed on said one end portion of said strap, whereby a relatively small strap loop can be formed between said one part of the buckle and said fitting for receiving and retaining and end portion of the coiled length of slender and flexible material.

2. A strap device according to claim 1, wherein the said one end part of the buckle is formed as the strap-bight-forming and cinching fitting.

3. A strap device according to claim 1, wherein the strap-bight-forming and cinching fitting is separate from the buckle as a slide slidably carried by said one end portion of the strap so as to be slidable on the strap to cinch said one end of the coiled length of slender and flexible material within said small loop.

4. A strap device according to claim 1, wherein the buckle is in two separable parts, one part receiving the said one end portion of the strap and the other part receiving the said other end portion of the strap.

5. A strap device according to claim 4, wherein the said other part of the buckle is formed as a strap-bight-forming and cinching fitting.

6. A strap device according to claim 4, wherein one part of the buckle is recessed to receive the other part of the buckle, said other part of the buckle being formed as a plug-in member for insertion in the recess of said one part with flanking, resilient, plug-in catch members adapted to be pressed toward each other by the user to release engagement between the two parts of the buckle.

7. A strap device according to claim 1, wherein the end portions of the strap have respective free ends; and wherein suspension means is carried by the free end of one of said free end portions of the strap.

8. A strap device according to claim 7, wherein the suspension means is carried by the free end of the end portion of the strap on which the strap-bight-forming and cinching fitting is slidably disposed.

* * * * *

UNITED STATES PATENT AND TRADEMARK OFFICE

CERTIFICATE OF CORRECTION

PATENT NO. : 5,075,932

DATED : December 31, 1991

INVENTOR(S) : Richard C. Hunt and Kenneth P. Kozole

It is certified that error appears in the above-identified patent and that said Letters Patent is hereby corrected as shown below:

In the Abstract, first line, "of" is deleted.

Column 1, line 24, "were" is inserted after "they".

Column 2, line 17, "thereform" is changed to "therefrom";

Column 3, line 26, "and" is changed to "an".

Signed and Sealed this

Twenty-seventh Day of April, 1993

*Attest:*

MICHAEL K. KIRK

*Attesting Officer*

*Acting Commissioner of Patents and Trademarks*